United States Patent [19]

Carney

[11] Patent Number: 4,784,173

[45] Date of Patent: Nov. 15, 1988

[54] WATER FREEZE PREVENTION VALVE

[76] Inventor: Frederick P. Carney, 229 Maplewood Estate, Scott Depot, W. Va. 25560

[21] Appl. No.: 202,818

[22] Filed: Jun. 6, 1988

[51] Int. Cl.[4] ..... F16K 31/64; E03B 7/12

[52] U.S. Cl. ..... 137/2; 137/60; 137/62; 137/79; 138/27; 138/32; 237/80

[58] Field of Search ..... 137/59, 60, 61, 62, 137/79, 2; 138/27, 28, 32, 34; 237/80; 251/147

[56] References Cited

U.S. PATENT DOCUMENTS

| | | | |
|---|---|---|---|
| 330,664 | 11/1885 | Bacon et al. | 137/62 |
| 360,139 | 3/1887 | Browne | 137/59 |
| 1,067,409 | 7/1913 | Daniel | 137/60 |
| 1,874,106 | 8/1932 | Labbe | 137/62 |
| 2,950,022 | 8/1960 | Boyer | 220/47 |
| 3,075,704 | 1/1963 | Stump | 236/66 |
| 3,369,556 | 2/1968 | Allerdice | 137/62 |
| 3,380,464 | 4/1968 | Arturbury et al. | 137/60 |
| 3,397,711 | 8/1968 | Strange | 251/147 |
| 3,446,226 | 5/1969 | Canterbury | 137/62 |
| 3,511,253 | 5/1970 | Ljutov | 137/60 |
| 3,618,625 | 11/1971 | Walters | 137/62 |
| 4,437,481 | 3/1984 | Chamberlin et al. | 137/60 |
| 4,638,828 | 1/1987 | Barrineau, Sr. et al. | 137/62 |

OTHER PUBLICATIONS

"The Ogontz ST Surface Temperature Sensing Control Valve", Bulletin ST-220, Ogontz Controls Company.

"The Ogontz TL Ambient Sensing Control Valve", Bulletin TL-340, Ogontz Controls Company.

"Ambitemp II", Brochure of Jordan Valve Division of Richards Industries, Inc.

"The Ogontz F Series Fluid Temperature Sensing Valves", Bulletin F-240, Ogontz Controls Company.

"Series 7810 Aldrain Valves", Spec. 7810, Brochure of Yarway Corporation.

"Winter Protection for Refinery Water Lines", The Spirax Sarconnection, vol. 3, No. 2, Spirax Sarco Inc.

"Kingston" Quick Opening-Self Closing Valves", Bulletin No. 103-81, F. C. Kingston Company.

"Kingston" Quick Opening Self-Closing Steam Valve, Bulletin 103-A-82, F. C. Kingston Company.

"150 Lb. 'N-M-D' Quick Operating Valves", Brochure of the Lunkenheimer Co.

"200 Lb. Bronze Regrinding Quick Operating Valves", Brochure of the Lunkenheimer Co.

"'CP' & 'CPA' Series Pipe Ended Check, Adjustable Relief & Popoff Relief Valves", Brochure of the Nurpo Company.

"Kunkle Brass/Bronze Relief Valves", Brochure of the Kunkle Valve Company.

"Temperature Control Valve and Steam Trap Applications Handbook", Ogontz Controls Company, 1984.

*Primary Examiner*—George L. Walton

*Attorney, Agent, or Firm*—Depaoli & O'Brien

[57] ABSTRACT

A freeze prevention device for water systems includes a relief valve and an actuator having an elongated chamber which contains water and segments that sequentially sense the incremental expansion caused by ice formation therebetween. The segments are axially aligned within the chamber. The segments may be balls, truncated pyramids, and the like that have a sealing portion and an axial portion with a foot which is adapted to engage an adjusting screw or a wear compensating spring at the bottom of the chamber or the top of the adjacent segment. An actuation linkage transmits linear meovement of one or more segments to a poppet in a valve seat, thereby opening a valve port connecting water, from a water supply system or a tank, to a discharge port, whereby water may be bled from the water system to prevent freezing thereof, or steam from a steam system for admission to tracer lines.

33 Claims, 6 Drawing Sheets

WATER FREEZE PREVENTION VALVE

BACKGROUND OF THE INVENTION

1. Field of the Invention

This invention relates to freeze protection devices and more particularly to a valve assembly which is automatically responsive to ambient temperatures at the freezing point of water, whereby damage to aqueous systems caused by freezing of water in pipes can be automatically prevented without reliance upon external sources of power.

2. Review of the Prior Art

Power failures during blizzards in northerly climates can cause severe freezing damage to pipes and water damage to the interiors of unoccupied homes during a subsequent thaw. Such freezing can occur in both water supply systems and hot water and steam heating systems. In addition, freezing of water in pipes, causing rupture of the pipes and subsequent damage to buildings by melted water, is a common difficulty in areas of the world where severe freezing is sufficiently infrequent that plumbing design does not include complete thermal protection. Such freezing is by no means limited to exposed faucets and can occur in any unprotected water pipe when ambient temperatures drop to 32° F. and below. Manually opening an exposed valve, to allow steady dripping from a water supply system at the onset of potentially freezing weather, is commonly done to prevent such damage. However, it is necessary that a householder be aware of an oncoming freezing period and remember to open and close the valve. Moreover, if the householder is away from home when the freezing occurs, or if the home is a vacation home in an area where freezing is normally unexpected, such manual opening for freeze protection may be unavailable.

Many freeze protection devices have been developed, but they generally require an external power source, use complicated springs or bellows devices, or rely upon o-rings or other sealing means which are susceptible to undisclosed failure.

U.S. Pat. No. 3,369,556 of Allderdice describes a freeze protection valve for water supply systems. The valve has a single bellows filled with water which expands when it freezes to move a valve element off its seat against the water pressure within a water line. This valve must be mounted vertically so that bypass water passes upwardly through the device to be discharged. This freeze device requires a loss motion adjustment for its bellows system to permit free expansion and contraction of the water contained therein.

U.S. Pat. No. 3,380,464 of Arterbury, et al describes a temperature-responsive valve adapted to be installed in a water line to protect it against freezing by opening a bleed actuator which comprises an elongated housing surrounding an annular expansion chamber and an axially disposed valve member which is hollowed to allow bypass water to flow through and be discharged from the valve member while heating the inner wall of the expansion chamber. To enhance such heat transfer, a portion of the valve member extends into the water line. After the valve has been opened to bleed water from the water line, it thereafter closes because of such heat transfer and is again in position to operate responsively to freezing ambient temperatures. The valve thereby utilizes the concept of heat balance between heat supplied by the flowing water and heat lost to the atmosphere.

U.S. Pat. No. 3,618,625 of Walters is directed to preventing freezing of water within a watering tank for animals which is connected to a pressurized source of warmer water. The tank has an inflow inlet conduit and a valve device which regulates outflow. This valve device comprises a sensing bulb connected to one end of a tubular conduit which is connected at its other end to a bellows and an outflow tube having a valve heat surface. When freezing temperatures are sensed by the bulb, there is an outflow of water from the valve device and an inflow of water from the inlet conduit, thereby preventing freezing of water within the tank.

U.S. Pat. No. 4,638,828 of Barrineau, Sr., et al. discloses an automatically operated valve to prevent freezing of water lines. The water faucet has female threads to accommodate a drip valve which is threaded into a standard "tee" type plumbing fitting. The drip valve includes an elongated housing having a temperature monitoring device within its upper end and a moveable tip at its lower end. When water temperature falls to freezing levels, a wax-like substance in the upper portion of the device contracts, causing the tip to reflex and allow water to flow through an opening at the bottom of the device.

The TL ambient sensing control valve for steam tracing systems and the Type F and Type AF valves for water systems, both sold by the Ogontz Controls Co., 141 Terwood Road, P.O. Box 479, Willow Grove, Pa. 19090, utilize an operating spring and an overtemperature spring. An externally disposed thermal actuator, filled with a solid-liquid phase wax, is on one end of the valve yoke which is connected to these springs and has a silicone plug on its other end for engaging the valve seat. These devices can be set for operation at a selected temperature.

None of the prior art devices can be considered safe from mechanical failure before onset of freezing weather. Devices requiring adjustment to set the temperature of actuation are subject to wrong settings or to change of settings caused by movement in the mechanism. Other devices containing an actuation chamber filled with water or another expansible substance can be subject to undetected leakage through o-rings, seals, or threads, and consequently will fail to open during subfreezing conditions. If such failure occurs, the condition will not be visible in these devices until after the freeze has been followed by a thaw.

Still other devices depend upon an outside source of power for actuation. If there is a power failure, the device will fail to operate, and freeze damage will occur.

Moreover, industrial factories and chemical plants in many parts of the world have numerous pipelines and equipment containing water that are protected from freezing by heating with steam. The steam is used to heat the water by direct injection of steam into the water or by indirect heating of the water by using coils containing steam in direct contact with water, such as a coil of tubing or a plate coil submerged in a water tank, or by using coils containing steam in contact with the wall of the system containing the water. Examples of such indirect contact are: tubing (usually copper) containing steam strapped to a water pipeline, tubing containing steam wrapped around a tank, and a steam-plate coil containing steam strapped to a tank containing water.

In most instances, the system containing the steam and the system containing water are both wrapped with insulation. Systems containing water may include water lines, return steam lines, and aqueous solution lines. Such lines may be hundreds of feet long, and rupture thereof during freezing weather, as can occur during a power failure, can cause shutdown of an entire plant.

Thus, there is a need for a completely failure-safe freeze prevention valve that is useful under industrial conditions, automatically responsive to freezing temperatures and to thawing temperatures, completely reliable as a standby device, entirely independent of outside power sources, incapable of leaking, and operable without periodic maintenance.

Furthermore, in those parts of the country in which pipelines and equipment are subjected to sub-freezing conditions, the steam used for protecting water systems in most industrial plants is turned on manually in the fall of the year, before a freeze occurs, and is turned off manually in the spring, after the last freeze. This practice is particularly prevalent for water lines that are steam traced and insulated. It results in a loss of steam energy while the steam system is on during ambient temperatures that are above freezing.

There is, accordingly, a need for a failure-safe freeze prevention valve for industrial plants that is automatically operable during freezing weather and is automatically inoperable under other weather conditions without manual or electrical operation thereof.

SUMMARY OF THE INVENTION

It is accordingly an object of this invention to provide a device which furnishes completely dependable protection against freezing and consequent damage to water systems and the interiors of homes and other buildings.

It is another object to provide a water freeze prevention device which is automatically responsive to ambient temperatures that are at and near the freezing temperature of water.

It is still another object to provide a water freeze prevention device that is sensitive both to the ambient temperature and to the temperature of the water system in order to minimize the amount of water that must be wasted to prevent freezing of the water system.

It is an additional object to provide a water freeze prevention device that does not require venting of air during operation thereof.

It is a further object to provide a water freeze prevention device that derives its motive force entirely from the freezing of water within the device.

It is a still further object to provide a water freeze prevention device that is not subject to failure because of failure of o-rings, seals, or threaded connections.

It is still another object to provide a steam-actuating freeze prevention valve that is automatically operable during freezing weather and inoperable during above-freezing weather.

In accordance with these objects and the principles of this invention, it has surprisingly been discovered that the freezing of water can be utilized as the sole source of power for opening a relief valve which is connected to a water or steam system, such as a water supply system, a closed water tank, or steam tracer lines, thereby respectively bleeding or draining water therefrom or admitting steam to the tracer lines and thereby preventing damage to the system and subsequent water damage during a thaw. It has also been discovered that the freezing of water can be utilized to provide an internal sealing means that requires no additional sealing device, such as an o-ring. It has additionally been found that the freezing of water can be utilized to bleed water lines and to operate steam tracer lines for protection of aqueous systems during freezing weather but not during thaws.

This invention utilizes the volumetric expansion of water while it freezes in a water-filled actuation chamber that is elongated and operably connected to a linkage means for transmitting expansion of the freezing water to a valve poppet controlling a discharge port which is connected to (a) a water system, which is herein defined as a water or aqueous solution supply system of pipes, valves, and the like, a water or aqueous solution storage system of one or more tanks, or a water heating system comprising a water heating device, circulating pumps, pipes, valves, and the like, and/or (b) a steam system for tracer lines protecting industrial pipelines and the like.

The invention more specifically comprises an actuator for a temperature-responsive valve, having a valve poppet and a valve seat, which is connected to a water or steam system that is exposed to a freezing ambient environment, comprising:

A. a housing which encloses an elongated chamber having a closed end, an open end, and a central axis, this chamber being filled with water and in flow communication with the water or steam;

B. at least one segment of an expansion sensing means which is disposed within the chamber; and C. a linkage means for axially transmitting movement of the segment to the valve poppet when freezing of the water within the chamber initially forms a seal between the housing and the segment and then causes the distance between the segment and the closed end to increase.

These segments are preferably balls which fit closely and are freely movable within the chamber which is preferably cylindrical in cross section. The segments may also be shaped as truncated double cones and be aligned within the chamber so that ends of the cones are in abutting relationship and substantially coincide with the central axis of the chamber. As another embodiment, each segment may comprise a disk and an axially aligned rod.

Broadly defined, the sensing means comprises at least one segment, and preferably two or more, such as four to eight segments, each comprising a transverse portion having a periphery which is approximately adjacent to the inner surface of the wall of the chamber and a longitudinal portion which spaces the segments apart and provides expansion space beneath the periphery. Most preferably, the chamber is cylindrical, and the segments are balls which fit closely but moveably within the chamber.

Both the segments and the chamber are preferably formed from the same material in order to minimize corrosion. Suitable materials include non-corrosive alloys, such as copper alloys and stainless steels, preferably the 300 series of stainless steel. Copper alloys include bronze, brass, and industrial copper.

The linkage means comprises an actuation rod which is axially aligned with the housing and in firm contact at one end with the surface of the uppermost segment and in contact with a valve poppet at the other end. Expansion of the water to form ice within the chamber causes axial movement of the rod, without destroying the ice seal between the periphery and the wall. This rod movement separates the valve poppet from the valve seat and allows a selected amount of water to be discharged from the water system or a selected amount of steam to enter the steam heating system.

The actuator may be disposed in any position from vertical to approximately 45° from vertical, provided that air escaping from the water within the chamber is always able to leave the chamber at its upper end. Such positioning is referred to herein as being substantially vertical.

The invention may further be described as a device for: (a) bleeding water from water and steam systems, and/or (b) admitting steam to steam heating coils, steam tracing lines, and the like when ambient air temperatures are approximately at freezing temperatures, comprising:

A. a temperature-responsive actuator, comprising:
  (1) a housing which encloses an actuation chamber containing control water and having an open end,
  (2) a means for sensing expansion of at least a portion of the control water toward the open end at the freezing temperatures, and
  (3) an actuation rod which is disposed within the chamber and is operably in contact with the expansion sensing means;

B. a relief valve which comprises a valve body having:
  (1) an inlet end which is sealably connected to the system,
  (2) an outlet end,
  (b 3) a control opening at which the housing is sealably connected at its open end, whereby the chamber is in flow communication with the inlet end,
  (4) a valve seat,
  (5) a valve port which is interposed between the inlet and outlet ends for conducting water and/or steam therebetween and which passes through the valve seat, and
  (6) a valve poppet for opening and closing the port when the control water freezes within the chamber and the linkage rod transmits the expansion from the expansion sensing means to the valve poppet, the valve poppet being in contact with the actuation rod, operably disposed within the valve, and adapted for fitting against the valve seat when the water is at temperatures above freezing temperatures; and C. a biasing means for pressing the poppet against the valve seat.

The expansion sensing means preferably comprises a plurality of segments which incrementally form a plurality of ice seals and sense the expansion of the water at the freezing temperatures. Heat from the valve selectively moves toward the closed end of the actuator through the wall of the housing, the actuation rod, the segments, and the water within the chamber while heat is moving outwardly through the wall and the bottom end of the housing. Freezing conditions are consequently maintained within the chamber up to a heat balance zone where heat inflow balances heat outflow. If this zone is below the periphery of the lowest segment, the actuator will not operate because an ice seal cannot form. If always above the lowest segment, the actuator will operate with only one segment. However, a plurality of segments provides flexibility for the actuator, i.e., a variable quantity of water may be selectively bled from the valve in accordance with the height of this zone above the bottom of the chamber. The valve body additionally comprises:

A. a valve cap, having a bore which is in alignment with the actuation rod;

B. a stem, which is attached to the poppet and is guided within the bore as the poppet opens and closes the port; and C. as the biasing means, a spring which is compressed between the cap and the poppet to maintain the poppet seated against the valve seat when ambient temperatures are above freezing temperatures.

The actuator also comprises a shaft cap screw which provides a means for bleeding air from the chamber after initial installation. The selectively extended shaft of the cap screw also provides an additional reservoir of water at the closed end of the chamber, beneath the bottom segment. A wear compensation spring may be disposed around this extended shaft in order to compensate for slight wear of the segments. Its force is always less than the force of the biasing means for pressing the poppet against the valve seat.

The segments of the expansion sensing means also function as an incremental sealing means because formation of ice initially occurs at the bottom of the chamber and along the interior surface of the housing (i.e., the wall of the chamber) and then between the wall and the periphery of each segment before freezing of water and resultant expansion occurs within the interior of the chamber, progressively moving between the segments from the closed end of the chamber toward the valve.

The flow rate of a fluid at a stated pressure can be selectively varied by changing the size of the opening created by lifting the valve poppet from the valve seat. This opening can be selectively altered by changing the length of the actuator or by changing its diameter, for the amount of axially disposed ice that is available for creating linear expansion is a function of the number of inter-segment spaces. The more balls, for example, that are within the chamber, the more spaces are available, and the greater the expansion that can be sensed.

Although the housing can be thermally isolated from the relief valve and the water contained therein, it is preferred that a thermally conductive path be provided so that heat transfer by conduction is available from the relief valve and into the chamber. Such heat conduction occurs: (a) along the wall of the chamber toward its bottom, and (b) through the actuation rod into the topmost segment and thence to the underlying water and/or ice and to the lower segments. However, when the ambient temperature is below freezing, this heat is removed laterally and rapidly from the housing to the surrounding air. Where the incoming and outgoing heat transfers are equal, a heat balance zone is established. Its distance from the bottom of the chamber directly controls the amount of expansion that occurs and the quantity of water that is bled from the system.

The method of this invention, for incrementally and cumulatively sensing the expansion of a liquid while freezing, comprises:

A. providing an actuator having an elongated housing which is disposed substantially vertically and has a wall, an open end, and a closed end to define an elongated actuation chamber which is filled with the liquid;

B. providing a plurality of segments of a sensing means which is disposed within the chamber, each segment having an uninterrupted peripheral portion extending substantially to the wall and an axial portion extending toward the closed end, these segments being biased toward the closed end;

C. providing a linkage means that is in contact with the topmost segment and is aligned substantially axially with the housing;

D. exposing the actuator to freezing temperatures;

E. forming an ice seal between each peripheral portion and the wall when freezing of the liquid initially occurs near the closed end and along the wall; and F. moving each segment sequentially upwardly without destroying the seal when freezing of the liquid occurs above the closed end and beneath each segment, whereby the linkage means is pushed upwardly.

In addition, the incrementally and cumulatively sensed expansion is transmitted by the linkage means to the poppet of a valve controlling flow of a fluid that is to be protected from freezing or that is to be used to protect another liquid from freezing. The fluid may be the liquid in the chamber or may condense to form this liquid.

The freeze prevention device of this invention comprises a fluid control valve and an actuator, the valve comprising a poppet and a valve seat which is adapted to be closed by the poppet and which controls a valve port between a valve inlet and a valve outlet and the actuator comprising a housing which is disposed substantially vertically, is open at its upper end where it is connected to the valve, is closed at its lower end, and forms an actuation chamber which contains a liquid and is in fluid communication with the port. The method of operating this device comprises:

A. providing a means for sensing the expansion of the liquid while it freezes; and B. providing a means for transmitting the sensed expansion to the poppet, whereby the poppet is lifted from the valve seat and the fluid flows through the valve port.

Both the fluid and the liquid may be water or the fluid may be steam. The liquid may also be any other liquid which expands when changing from its liquid state to its solid state.

Valves made by the Lunkenheimer Co., P.O. Box 145487,Cincinnati, Ohio 45214 and by the S.C. Kingston Co., 1007 N. Main St., Los Angeles, Calif. 90012, are suitable for both water and steam control in the devices of this invention.

DESCRIPTION OF THE PREFERRED EMBODIMENTS

Experimental models of the water freeze prevention device of this invention were made of brass and tested under actual or simulated freeze conditions which are described hereinafter in the examples. Operational principles, as presently understood, are discussed thereafter.

Figure 1:
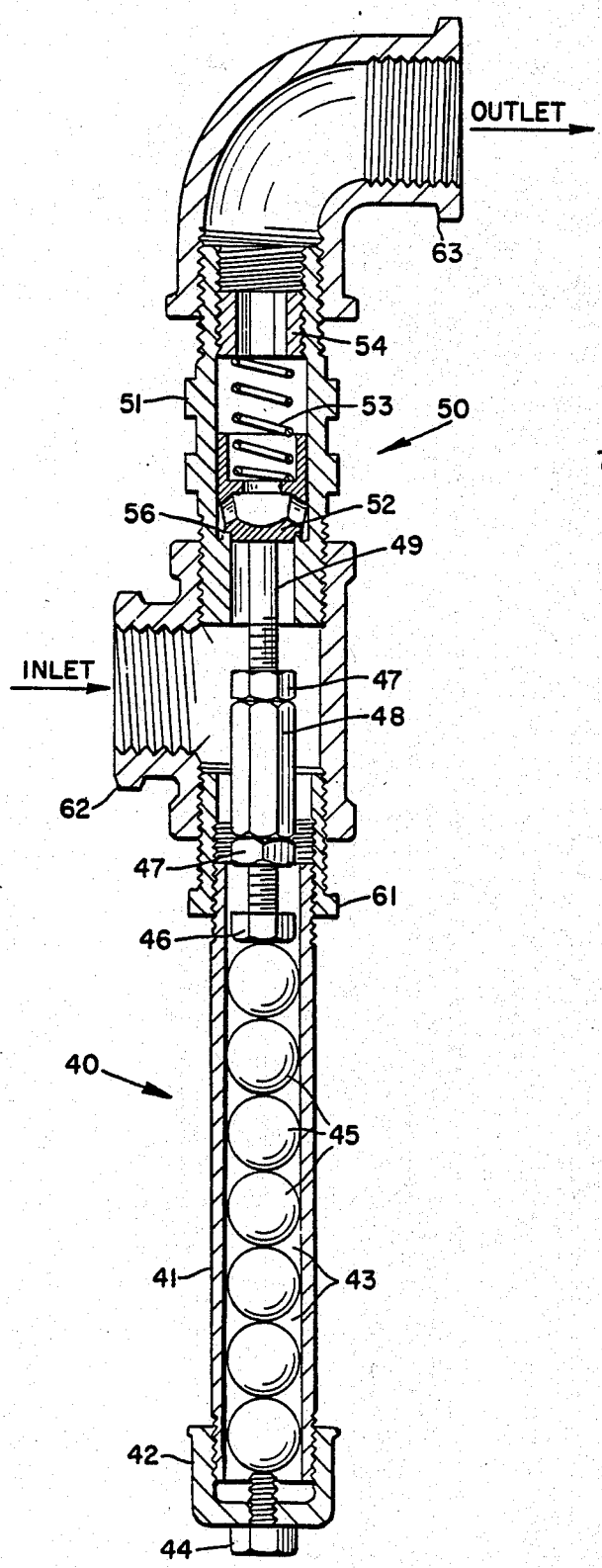
FIG. 1 is a sectional elevation of an experimental device of this invention, assembled from brass pipe and fittings.

The experimental prototype that is shown in FIG. 1 was made mostly of brass in order to avoid corrosion problems. It comprises an actuator 40 and a relief valve 50.

Actuator 40 comprises a housing formed from a ⅜-inch schedule 40 brass pipe nipple 41 which had been reamed on its inside to 0.505 inch, a ⅜-inch brass cap 42 which had been drilled and tapped to ¼-inch UNC, a ¼-inch plated steel bleed cap screw 44, a plurality of ½-inch diameter brass balls 45 as segments of its sensing means, and an adjustable actuation rod made of plated steel, consisting of a ¼-inch cap screw 46, two ¼-inch nuts 47, a ¼-inch long nut 48, and a ¼-inch threaded rod 49.

Valve 50 is a ½-inch adjustable in-line relief valve, model B-8CPA2-150 of the Nupro Company, 4800 E. 345th St., Willoughby, Ohio 44094. This valve comprises a ½-inch housing 51, which has NPT threads at both ends, a poppet 52, a compression spring 53, internal bushings 54, and a valve seat 56.

The valve had a soft seat with a metal stop, but only a metal-to-metal stop is needed for this invention. However, even if a soft seat is used and it eventually leaks, it will not affect the openability of the device.

Actuator 40 is threadably attached to a ½-inch x ⅜-inch brass bushing 61 which is in turn threaded into a ½-inch brass tee 62. Valve 50 is threadably attached to the other end of this tee, and a ½-inch brass ell 63 is threadably attached to the other end of valve 50.

Because nipple 41 was readily changed, this device was found to be very convenient for experimental work with a variety of segments replacing balls 45 as the means for sealing the actuation chamber and for sensing the linear expansion of water therewithin during its phase change into ice.

Figure 2:
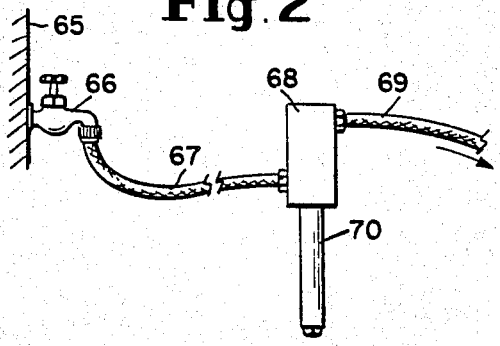
FIG. 2 is a diagrammatic sketch showing an experimental test arrangement.

Experimental usage of the device shown in FIG. 1 is illustrated in FIG. 2 in which a ¾-inch hose, having a length of 15 feet, was attached to an outdoor faucet 66 protruding from a building 65. The freeze prevention device of the invention, comprising a relief valve 68 and an actuation chamber 70, was attached at its inlet end to the discharge end of hose 67, and a ¾-inch drain hose 69 was attached to its outlet end. With faucet 66 open, the bleed screw at the bottom of actuation chamber 70 was opened until all air was purged from the system.

Tests were then run by exposing the valve to ambient sub-freezing conditions for a period of up to about 20 minutes, depending upon the ambient temperature, when the water would freeze in the actuation chamber and the valve would open to permit water to run to waste through hose 69. To simulate warming up of the ambient air, the experimenter would clasp actuation chamber 70 in one hand and observe the discharge of water from hose 69. Generally within 5–10 minutes, valve 68 closed. This operation was repeated several times to verify that valve 68 opened an closed.

Other tests were run indoors by immersing actuation chamber 70, detached from relief valve 68, in a mixture of ice and brine and observing discharge of water, shortly after immersion, indicating upward movement of the actuation linkage, and cessation of discharge after removal from the cold brine, indicating downward movement of the linkage.

During additional test for controlling the flow of either water or steam, the actuator was placed in a chest-type home freezer in order to simulate freezing conditions in still air.

These experiments are described in more detail in the following examples by means of which the invention may be more thoroughly understood.

EXAMPLE 1

Figure 3:
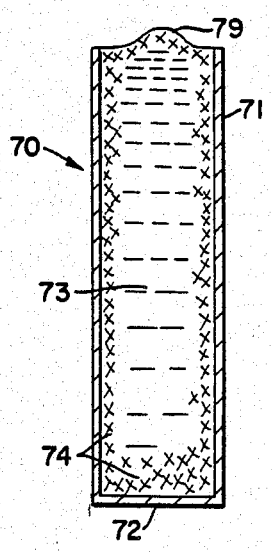
FIG. 3 is a schematic sectional elevation of an actuator, having no segments therein, in which the water is partially frozen.
Figure 4:
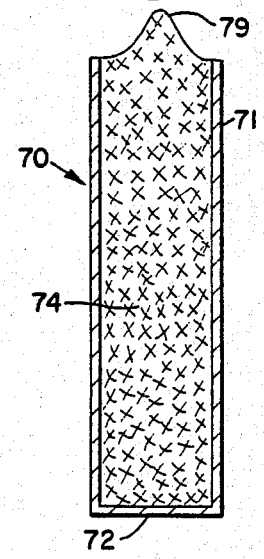
FIG. 4 is a schematic sectional elevation of the same actuator in which the water is entirely frozen.

Actuator 70, having cylindrical wall 71 and bottom 72 and filled with water 73, was observed under ambient conditions at a temperature of 25° F. Actuator 70 was made from a brass pipe having a length of 5 inches and an inside diameter of 0.505 inch after reaming. As water 73 progressively froze close to wall 71 and bottom 72 to form ice 74, a central cone-shaped hump or elevation 79 was formed, as shown in FIG. 3. When water 73 had completely frozen to form ice 74, central elevation 79 was noticeably larger, as shown in FIG. 4. This experiment showed that progressive freezing of water is from the outside wall of chamber 71 and bottom 72 into its central core.

EXAMPLE 2

Figure 5:
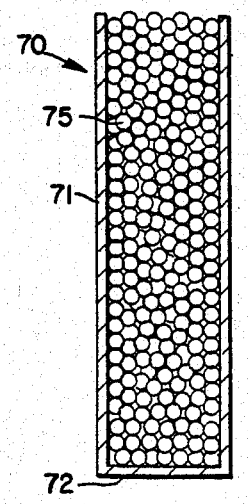
FIG. 5 is a schematic sectional elevation of the actuator shown in FIGS. 3 and 4 which is filled with water and many small balls.

Chamber 70 was filled with water and 166 small balls 75 having a diameter of 0.1742-inch, made of zinc-plated steel, as shown in FIG. 5. Ball-filled chamber 70 was then placed in the freezer portion of a refrigerator at a temperature of about 25° F. As freezing occurred and ice expanded, balls 75 did not move. Water was pushed up between balls 75 until all freezing was completed. Accordingly, this experiment failed because expansion of water between balls 75 could not actuate a relief valve, such as valve 50.

EXAMPLE 3

Figure 6:
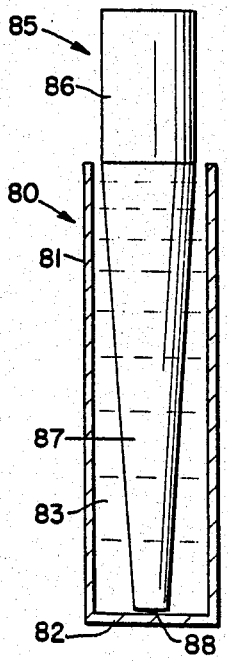
FIG. 6 is a schematic sectional elevation of the same actuator containing water and a circular, tapered pin.

An experiment was made with an actuation chamber 80, similar to chambers 40 and 70, and comprising side or wall 81, bottom 82, and a tapered pin 85 having a cylindrical portion 86 and a circular tapered portion 87 with truncated bottom 88 resting on bottom 82, as shown in FIG. 6.

When tested in a freezing environment, the actuation device operated successfully and provided re-actuation when the initial freeze was followed by a complete thaw, melting of all ice, and then by re-freezing. However, the device did not re-actuate the attached relief valve when the thaw was a partial thaw that was followed by a second freeze. The device operated successfully during the first freeze because water 83 expanded inwardly as it turned into ice and caused taper pin 85 to be wedged upwardly. However, after a partial thaw, the ice around the top of tapered portion 87 and adjacent to chamber wall 81 melted and water escaped from the chamber as pin 85 settled downwardly under pressure of the compression spring. When re-freezing began, there was still ice in the space between lower parts of tapered portion 87 and wall 81 so that there was little water available for further freezing and expansion.

EXAMPLE 4

Figure 7:
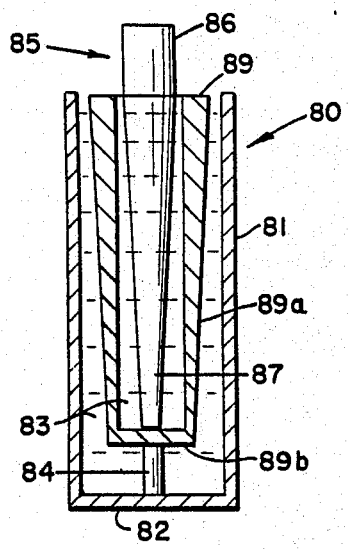
FIG. 7 is a schematic sectional elevation of the same actuator containing water, a floating tapered chamber, and the tapered pin of FIG. 6.

Further experiments were conducted with actuator 80 containing tapered pin 85, comprising cylindrical portion 86 and conical portion 87, within a floating tapered chamber 89, comprising tapered walls **89*a* and bottom 89b resting on pin 84, as shown in FIG. 7. Water 83 was within the chamber of actuator 80 and within tapered chamber 89**.

During freezing conditions, both tapered pin 85 and floating chamber 89 moved upwardly. It was anticipated that during a partial thaw that either the space between pin 85 and chamber 89 or the space between chamber 89 and wall 81 of actuator 80 would thaw to 100% water and then re-freeze. This did not occur, so that the experiment failed.

EXAMPLE 5

Figure 8:
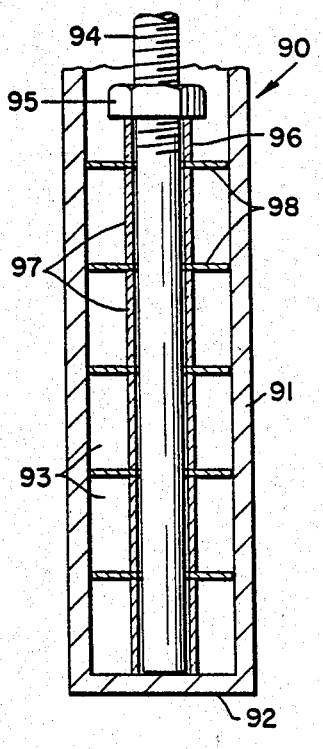
FIG. 8 is a schematic sectional elevation of the same actuator containing a centrally disposed rod and a plurality of spacers and washers as segments of the sensing means.

As shown in FIG. 8, an actuator 90, similar to actuators 70 and 80 and containing water 93, was fitted with a central rod 94 extending to bottom 92, a nut 95, a small collar 96, and a plurality of spacing collars 97 and washers 98 which extended substantially to cylindrical side 91.

A test was run under freezing conditions using this embodiment. The test failed; rod 94 did not move up during freezing of water 93. It is believed that water 93 froze from wall 91 inwardly and then, as expansion occurred, water escaped upwardly through the spaces between rod 94 and washers 98 before the central portion of water 93 froze.

It was concluded that segments of the sealing means would have to be solid in their centers in order to trap the water as it froze.

EXAMPLE 6

Figure 9:
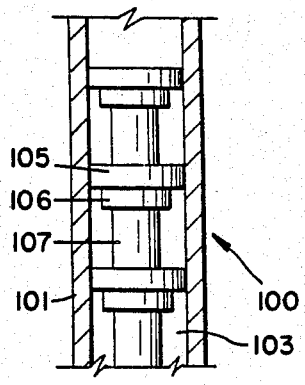
FIG. 9 is a partial schematic sectional elevation of the same actuator containing a plurality of plastic washers and steel sections as alternative segments.

As shown in FIG. 9, an actuator 100, constructed similarly to actuators 70, 80, 90, was provided with T-shaped expansion-sensing segments of its sealing means, each comprising a plastic sealing disk 105 having a thickness of 3/32-inch and a diameter of 178-inch, a plastic spacer disk 106 having a thickness of 3/32-inch and a diameter of ⅜-inch and a short steel rod 107, having a thickness of 5/16-inch and a diameter of ¼-inch. Disk 105, disk 106, and rod 107 were glued together to form each segment. The segments were stacked within cylindrical wall 101 of the chamber which was filled with water 103.

This assembly was tested by immersing actuator 100 and its contents in a container of brine and ice at 15° F. Freezing of the water and opening of the valve occurred within about two minutes, as indicated by discharge of water. After removing actuator 100 and warming it by hand, the valve closed, as indicated by cessation of the discharge. When re-immersed in the brine, it opened again and then closed again when warmed a second time.

EXAMPLE 7

Actuator 40, as shown in FIG. 1, was immersed in a container of brine and ice at 15° F. Within 5 minutes, valve 50 opened and water ran from drain hose 69. Actuator 40 was then removed from the brine container, and valve 50 closed within 10 minutes. These steps ere repeated several times. Valve 50 opened and closed in the same way as in the initial test.

EXAMPLE 8

Another test of actuator 40 was made out of doors while it was connected to a water supply system as shown in FIG. 2. The ambient temperature was 22° F. on a windy day. In 20 minutes, water 43 froze within the chamber of actuator 40, valve 50 opened, and the water ran to waste from drain hole 69. To simulate a warm, ambient atmosphere, actuator 40 was grasped in one hand. Within one minute, valve 50 closed. These steps were repeated several times. Valve 50 opened and closed in the same way.

EXAMPLE 9

A home freezer having an inside temperature of 8° F. was used for a series of experiments to determine the minimum number of segments that could used in the actuator. The freezer lid was shimmed with foam rubber so that the valve and actuator could be placed within the freezer and the inlet water hose and the waste water hose could be run through the foam. The freezer was used because it more closely approximated actual conditions, i.e., air-to-metal heat transfer on a quiet winter day, as compared to immersion of the actuator in a brine/ice mixture.

The prototype actuator 40 and valve 50 shown in FIG. 1 were used for these experiments. However, actuator 100 contained T-shaped segments as shown in FIG. 9 and as used in Example 6, except that the length of the rods 107 was varied as shown in FIGS. 24 and 25 which represent the lower portion of actuator 40 containing segments as shown in FIG. 9 rather than schematic actuators 70, 80, 90, 100.

The experiment was made by connecting inlet hose 67 to water-filled actuator 40 and opening and then closing bleed screw 44 at its bottom. The valve and actuator, comprising the experimental freeze prevention device, was then placed within the freezer. Discharge of water from waste water hose 69 was noted when it occurred, and the time elapsed was recorded. The freezer was opened when required, and the device was disassembled, when necessary, to determine the extent of freezing that had occurred.

Figure 24:
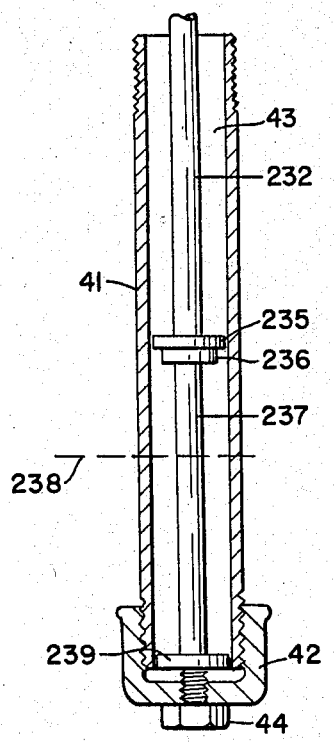
FIG. 24 is a schematic sectional elevation of a portion of an experimental actuator, as shown in FIG. 1, having a single piston-shaped (T-shaped in profile) segment.
Figure 25:
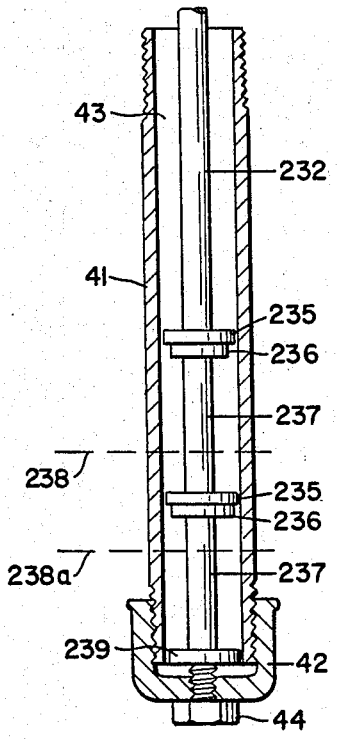
FIG. 25 is a schematic sectional elevation of the actuator portion of FIG. 24 which contains two piston-shaped segments, each having half the length of the segment of FIG. 24.
Figure 26:
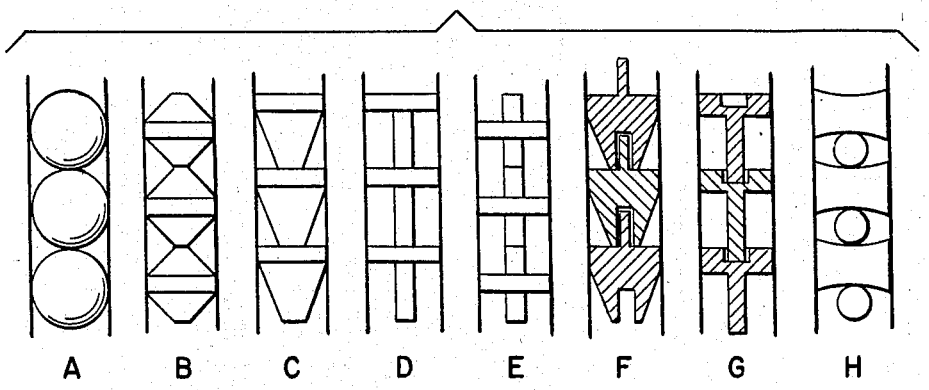
FIG. 26 shows, as schematic representations of an actuator in sectional elevation, eight usable shapes of solid segments that provide incremental sensing of the expansion of water into ice within the actuation chamber.

As shown in FIG. 24, actuator 40 was fitted with a supplemental actuation rod 232 to compensate for the segments not being used, a plastic sealing disk 235, a plastic spacing disk 236, a steel rod 237 having a length of exactly 2 inches, and a bottom disk 239 having the same dimensions as disk 236. Disk 235, disk 236, and rod 237 were glued together to form the single segment. The actuator was attached to globe valve 50 which was connected to the inlet and discharge hoses.

After 1½ hours within the freezer, there was no discharge of water from the discharge hose. The freezer lid was raised, and the device was removed from the freezer and disassembled. It was found that all water was frozen within the chamber and within the inlet water hose. It is believed that the reason for failure was that the freeze occurred so slowly that the heat leaving wall 41, cap 42, and screw 44 was replaced by heat moving downwardly from relief valve 50, whereby the heat balance zone was somewhere below sealing disk 235, such as at position 238. Water 43 consequently escaped between wall 41 of the chamber and the periphery of disk 235.

EXAMPLE 10

The same actuator, containing the single T-shaped segment tested in Example 9, was immersed in a mixture of brine and ice. The device performed successfully, as in Example 7, because the quick freeze caused an ice seal to form between the periphery of disk 235 and chamber wall 41.

EXAMPLE 11

As shown in FIG. 25, actuator 40 was fitted with two T-shaped segments, comprising the same supplemental actuation rod 232, two plastic sealing disks 235, two plastic spacing disks 236, two steel rods 237 having a length of exactly one inch, and the same bottom disk 239 that was used for Examples 9 and 10. Disk 235, disk 236, and rod 237 were glued together to form each segment. The actuator was then attached to globe valve 50 which was connected to the inlet and discharge hoses, as shown in FIG. 2.

The device was placed within the same home freezer at 8° F. Within 40 minutes, a small trickle of water (approximately ¼ gallon per minute) was observed to be running out of the discharge hose. The temperature of the water supply was 52° F. Fifteen minutes later, the water continued to trickle from the hose. After another 25 minutes, the trickle stopped.

The valve, hoses, and actuator were removed from the freezer. The valve was disassembled. It was found that only a small amount of ice was in the actuation chamber. Five minutes after removal from the freezer, the reassembled actuator was again connected to the globe valve and hoses and was replaced in the freezer. Within 40 minutes, the trickle of discharge water began again. Thirty minutes later, the trickle was observed to be continuing. After another 10 minutes, the trickle stopped.

At this point in the experiment, it appeared that the trickle was enough to melt the ice within the actuation chamber and that the actuator was alternately freezing and thawing. It was believed that the heat balance zone was initially above at least the lower disk 235, such as at position 238. Then when warmer water from inlet hose 67 began to flow through globe valve 50 and heat from this water transferred to tee 62, long nut 48, and screw 46 and then to wall 41 and rod 232, the heat balance zone moved downwardly to position 238*a*. The ice seal between the periphery of lower disk 235 and wall 41 and the ice therebelow then melted, causing poppet 52 to be lowered onto valve seat 56.

EXAMPLE 12

In order to be sure that the device would work with two segments when subjected to a higher heat loss, the valve, actuator, and hoses were removed from the freezer, and the actuator was placed in a container of brine and ice. Within about 5 minutes, the valve was running wide open, discharging about 3½ gallons of water per minute. After removal from the brine-ice mixture and exposure to ambient conditions (about 70° F.), the flow stopped within 10 minutes. The device was replaced in the brine, and within about five minutes, it ran wide open again.

EXAMPLE 13

In many industrial situations, steam tracer lines are used for tracing a large number of liquid lines that are subject 1 to freezing. These lines may be many feet in length and may contain various solutions, slurries, or pure water.

Figure 18:
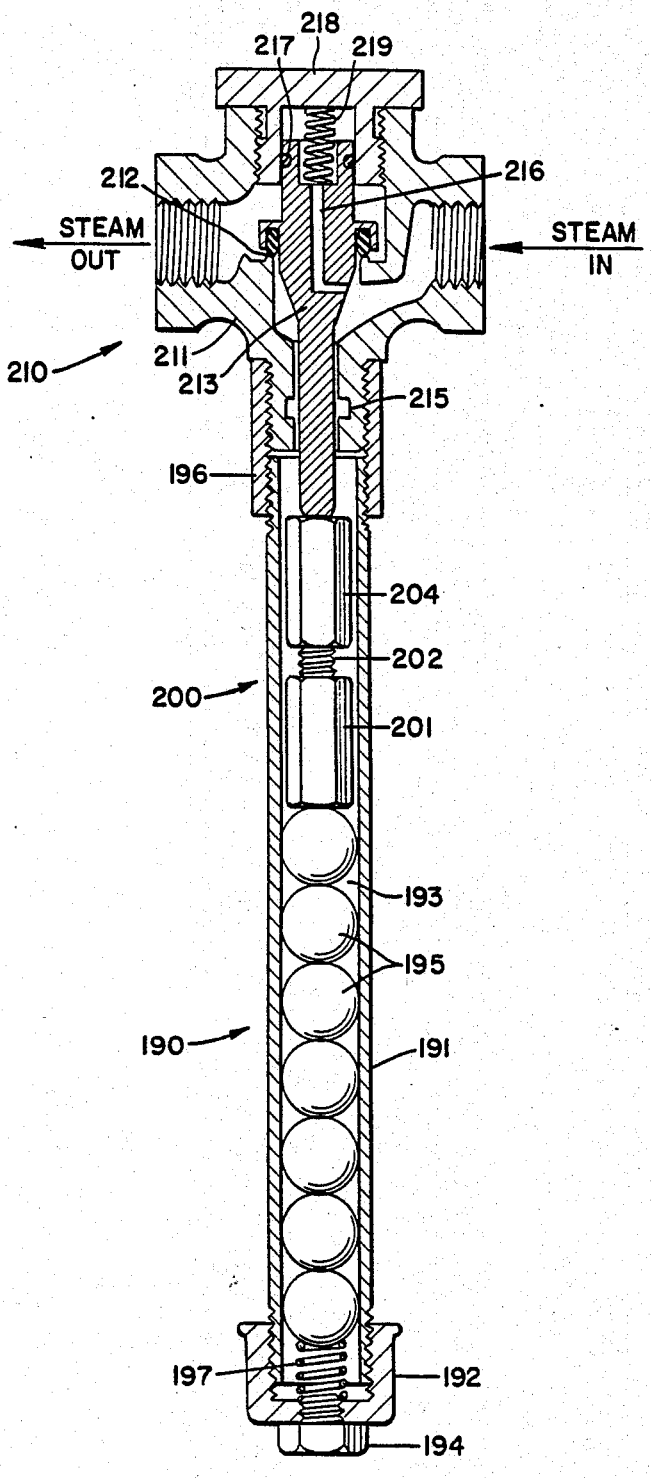
FIG. 18 is a sectional elevation of an experimental freeze prevention device in which the valve controls the flow of steam.

A suitable valve, for bleeding steam into such steam tracer lines when a freeze is beginning to occur and for shutting off such tracing steam when a thaw begins, is shown in FIG. 18.

Figure 20:
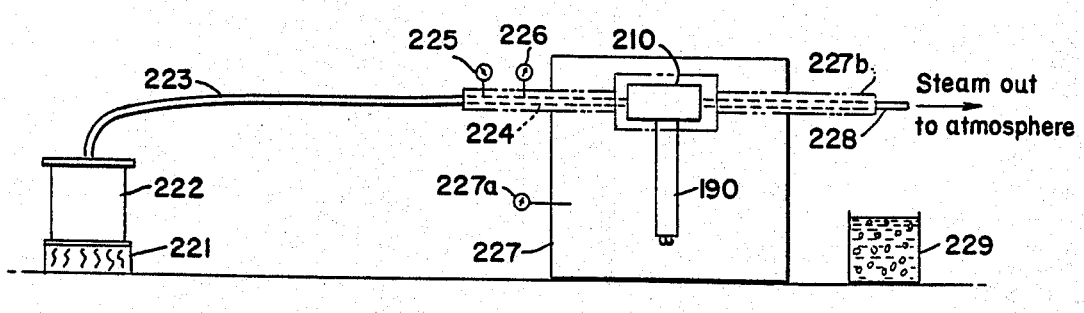
FIG. 20 is a diagrammatic sketch showing an experimental test arrangement for the devices of FIGS. 18 and 19.

Using a steam valve 210 connected to an actuator 190 as shown in FIG. 18, a test set-up was assembled as shown in FIG. 20. It consisted of an electric stove 221 and a 4-quart pressure cooker 222 within a house, approximately 30 feet of ⅜-inch plastic tubing 223 which was connected at one end to cooker 222, a copper tube (two feet in length) 224 which was connected to the other end of tubing 223, a steam temperature gage 225, a steam pressure gage 226, a home freezer 227 which was disposed in a garage, a freezer temperature gage 227*a*, insulation 227*b* of ½-inch thick foam insulation between the lid and body of freezer 227, a copper tube 228 (about 3 feet in length), and a brine/ice cooler 229, having a temperature of about 15° F. Valve 210 and actuator 190 were connected to inlet tube 224 and outlet tube 228.

The experimental device shown in FIG. 18, as a prototype water freeze prevention valve utilizing steam to heat the system, comprises valve 210 and actuator 190 which comprises a ⅜-inch brass pipe 191 having threaded ends and forming the housing wall for the actuation chamber, bottom end cap 192, water 193, bleed screw 194, balls 195 as segments of its sensing means, galvanized steel pipe coupling 196, and wear compensation spring 197. Actuation rod 200, functioning as the linkage means between balls 195 and valve 210, comprises ¼-inch lower long nut 201, threaded rod 202, and ¼-inch upper long nut 204. Steam valve 210 comprises valve body 211, valve seat 212, valve poppet 213, vacant o-ring slot 215, equalizing port 216, o-ring 217, valve cap 218, and compression spring 219.

The test was begun by turning on hot plate 221. While valve 210 was outside of freezer 227, pressure within cooker 222 rose to 20 psig. Bleed screw 194 was opened for 3 minutes to purge air from the system and was closed when steam flowed freely from cap 194.

Valve 210 and actuator 190 were then placed in freezer 227 when temperature gage 227*a* indicated 12° F. It was expected that condensed steam within the chamber would fill it with water. Steam pressure, as shown by pressure gage 226, was maintained between 15 psig and 20 psig for 65 minutes by turning hot plate 221 on and off; valve 210 did not open.

Valve 210 and actuator 190 were then removed from freezer 227 and placed in brine/ice container 229. Steam was discharged in 3 minutes from line 228.

Valve 210 and actuator 190 were immediately replaced in freezer 227. Valve 210 remained open for 4 minutes while steam pressure, as indicated by gage 226, was about 0 psig and steam temperature, as indicated by gage 225, was about 212° F. The flow of steam through line 228 apparently ceased because of heat transfer from flowing steam in valve 210 to actuator 190.

The test procedure was repeated by removing valve/actuator 210/190 from freezer 227 and immersing actuator 190 in container 229. Valve 210 opened in about 6 minutes.

Valve/actuator 210/190 were immediately replaced in freezer 227. Steam continued to run for about 3 minutes.

It was concluded that heat transfer from valve 210 to actuator chamber 190 was too rapid. Specifically, heat conducting conditions were too favorable and/or the distance from valve 210 to the lowest ball 195 was too short, so that heat from the heated metal of valve 210 melted the ice too rapidly.

EXAMPLE 14

Figure 19:
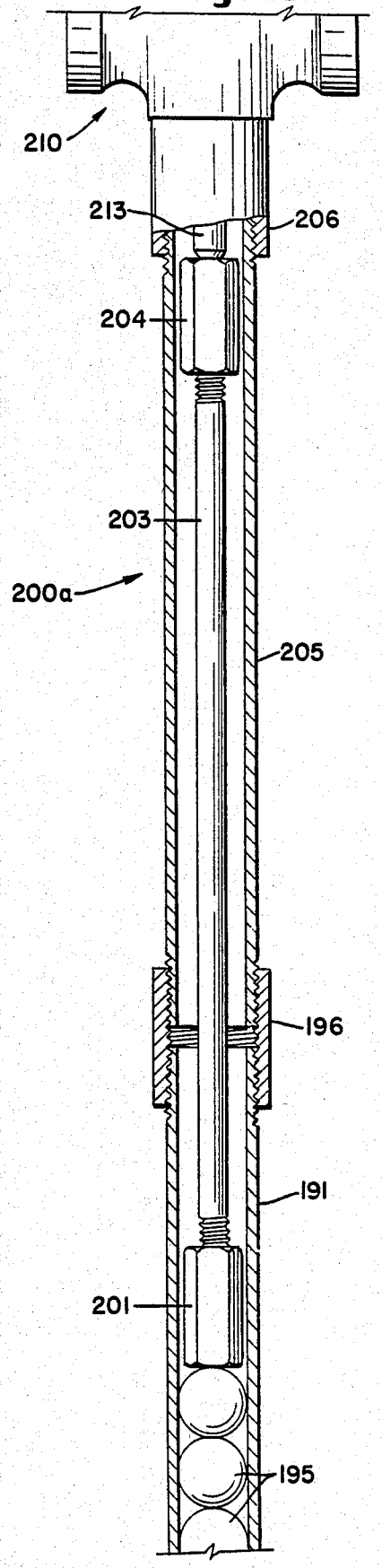
FIG. 19 is a sectional elevation of the extended actuation rod between the actuator and the valve of FIG. 18.

Actuator 190 was separated further from valve 210 by inserting a ⅜-inch galvanized steel pipe 205, 6 inches long and threaded at both ends, between housing wall 191 and valve body 211, as shown in FIG. 19. Actuation rod 200 was then lengthened by replacing threaded rod 202 with a ¼-inch adjustable extension rod 203 of galvanized steel which was similarly threaded into long nuts 201, 204. Coupling 196 was used to attach the lower end of pipe 205 to wall 191, and another coupling 206 was added to attach the upper end of pipe 205 to valve body 211. Steel was selected for rod 203 and pipe 205 because its heat conductivity is less than that of brass.

This lengthened test device was connected to copper tubes 224, 228, as shown in FIG. 20, for tests in which brine container 229 was not used. Hot plate 221 was turned on while the device was outside freezer 227, and the pressure was raised to 20 psig. Bleed screw 194 was opened to fill the chamber with steam.

Valve 210 opened and closed three times during the duration of the test (3 hours, 34 minutes). The time and freezer temperature, as measured by gage 227*a*, were noted at each change.

The device was placed within freezer 227 which was at 10° F. and which rose in temperature to 16° F. in 30 minutes. The device was kept within freezer 227 for the duration of the test.

The test results for the lengthened test device are summarized in the following table.

| Test | TIME REQUIRED, MINUTES | | FINAL TEMPERATURE IN FREEZER, °F. | |
|---|---|---|---|---|
| No. | To Open | To Close | Valve Open | Valve Closed |
| 1 | 79 | 25 | 16 | 20 |
| 2 | 91 | 28 | 15 | 18 |
| 3 | 95 | 26 | 14 | 20 |

This test was considered to be successful because valve 210 was open for approximately 30 minutes and was shut for approximately 90 minutes while at ambient temperatures of 15°–20° F. in still air. In a practical situation, an insulated and steam-traced line would probably be heated to over 100° F. in 30 minutes but would require several hours to cool to 32° F. in ambient temperatures of 15°–20° F.

During colder ambient temperatures, the water system will cool faster and need more protection, but this will be offset by the valve off-cycle being reduced so that the valve stays open for a longer time.

It is also pertinent that these freezer tests were performed in still air, whereas under field conditions, there will usually be air movement that could increase heat conductance from 3 to 5 times, thereby causing the valve to remain open for a longer time. An additional factor is that the tests were performed with steam at 250°–257° F. and 15–20 psig. Under field conditions, the steam temperature could be 75 psig, causing the valve temperature to approach 320° F. Using a base temperature of 30° F., this higher temperature would increase heat flow to the actuation chamber as follows: $(320-30)/(212-30)=1.6$, or a 60% increase in heat flow, causing the valve to close more quickly. However, the higher temperature would heat the traced line more rapidly.

The length of extension rod 203 should be directly proportional to the heat conductance of its material of construction. Galvanized steel was used for this test, but Ryton® and other high-temperature plastic materials of low conductivity, such as Kevlar®, are also suitable.

DISCUSSION OF OPERATIONAL PRINCIPLES

The test conducted as described in Examples 7 and 8 with balls 45 in actuator 40 may be understood more clearly by reference to FIGS. 10–15 which are schematic drawings in sectional elevation of the valve shown in FIG. 1 and of actuators 70, 80, 90, 100. Actuator 110 comprises cylindrical side 111, bottom 112, adjustment screw 114, a plurality of balls 115 fitting closely but moveably within cylindrical side 111, actuation rod 116 in contact with topmost ball 115, actuation pin 117 which is connected and attached to rod 116, valve poppet 118, and compression spring 119 which forces poppet 118 against valve seat 121.

Figure 10:
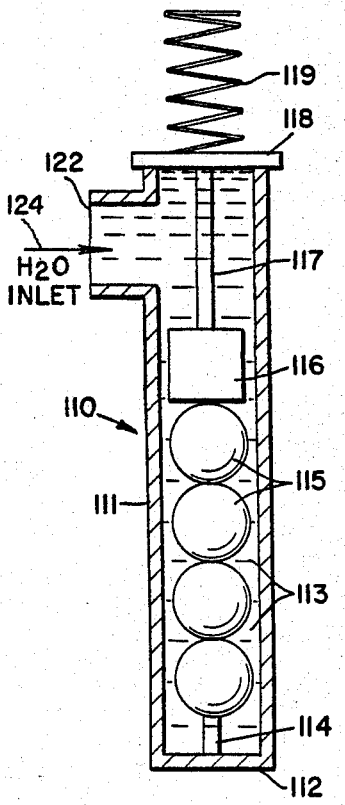
FIG. 10 is a schematic sectional elevation of the freeze prevention device of this invention, containing water and a plurality of axially aligned balls as such segments, in closed position.
Figure 11:
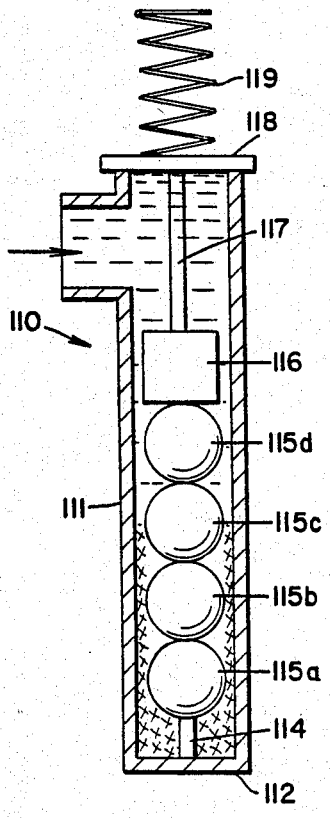
FIG. 11 is a schematic sectional elevation of the device as in FIG. 10 in which the water has begun to freeze.
Figure 12:
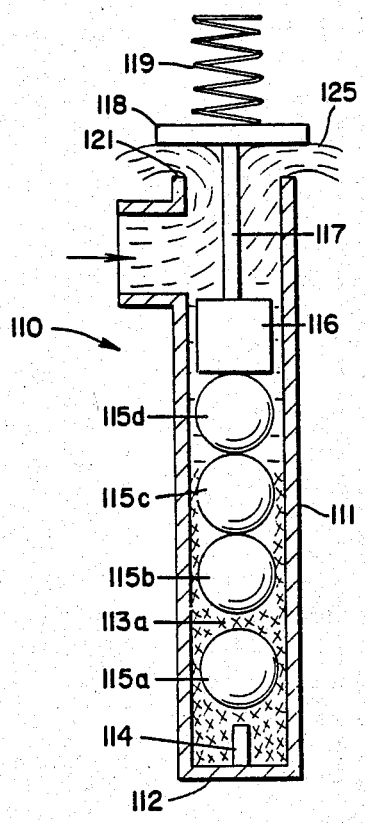
FIG. 12 is a schematic sectional elevation, like FIGS. 10 and 11, in which the water has partially frozen and the relief valve has partially opened.

Actuator 110 contains water 113 when the ambient temperature is above 32° F., as shown in FIG. 10. When the ambient temperature drops below 32° F., freezing of water 113 starts at wall 111 and at bottom 112, below ball 115*a*, forming a seal between balls 115*a* and 115*b*, and between ball 115*c* and wall 111, as shown in FIG. 11. As the temperature continues to be below 32° F., freezing becomes complete around lower balls 115*a*, 115*b*, 115*c*, to form ice 113*a*, forcing ball 115*a* from its seat on adjustment screw 114 to form a first space and forcing ball 115*b* upwardly to form a second space between it and ball 115*a*. Ice has not completely solidified, however, between ball 115*b* and ball 115*c*, as shown in FIG. 12. Expansion within these two spaces, transmitted upwardly to actuation rod 116, has lifted poppet 118 from valve seat 121 so that inlet water 124, entering inlet opening 122, flows as bleed water 125 from the partially opened relief valve.

Figure 13:
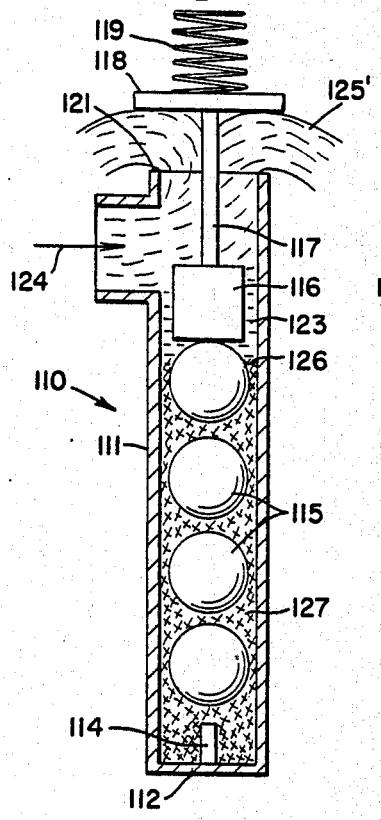
FIG. 13 is a schematic sectional elevation of the device of FIGS. 10–12 in which the water has completely frozen and the valve has completely opened.

As the ambient temperature continues to be below 32° F., the freeze becomes complete within the chamber of actuator 110 around all balls 115 therewithin. There is a space between adjustment screw 114 and lowermost ball 115*a* and additional spaces between each of the succeeding three balls, as shown in FIG. 13. These four spaces provide additional lift to valve poppet 118 so that flow 125' is noticeably greater than flow 125. At this flow rate, bleeding continues to provide maximum protection during the lowest temperature of the freeze.

Figure 14:
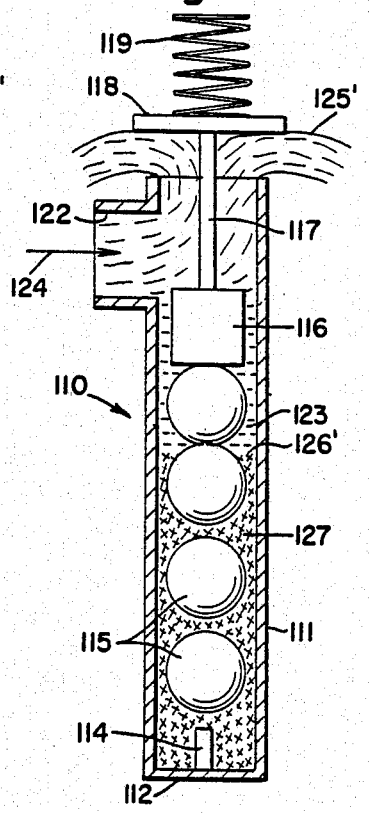
FIG. 14 is a sectional elevation of the valve of FIGS. 10–13 in which the valve has begun to close at the onset of a thaw.
Figure 15:
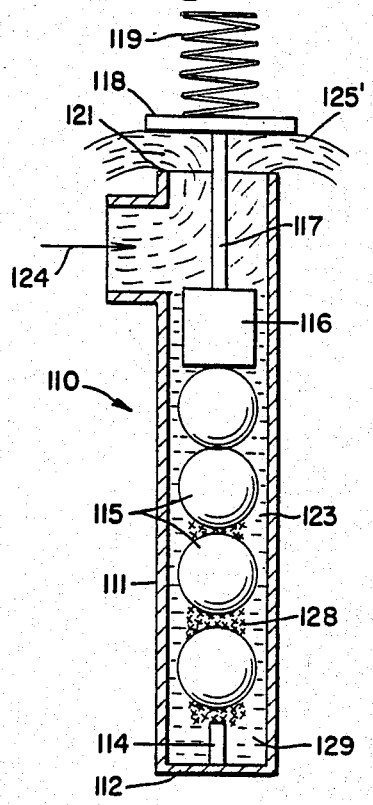
FIG. 15 is a sectional elevation of the valve of FIGS. 10–14 in which the valve has not yet closed but which shows more complete melting of ice within the actuator chamber with the exception of a small amount of ice between the lower three balls.

FIGS. 14 and 15 schematically depict the onset of a thaw. Heat flowing downwardly from inlet piping connected to inlet 122 and flowing water 124 therewithin through wall 111 has melted ice to form water 123 below topmost ball 115*d* in FIG. 14 and has melted ice to form water 123 below second ball 115*c* in FIG. 15, in combination with incoming heat from the surrounding air through wall 111 which has formed additional water 129 at the bottom of the chamber. Residue ice 128 remains below the three lowest balls. The heat balance zone is approximately at top 126 of the ice during the coldest temperature, as seen in FIG. 13 but has advanced to ice level 126' in FIG. 14 during the thaw.

Preferred Embodiments

Figure 16:
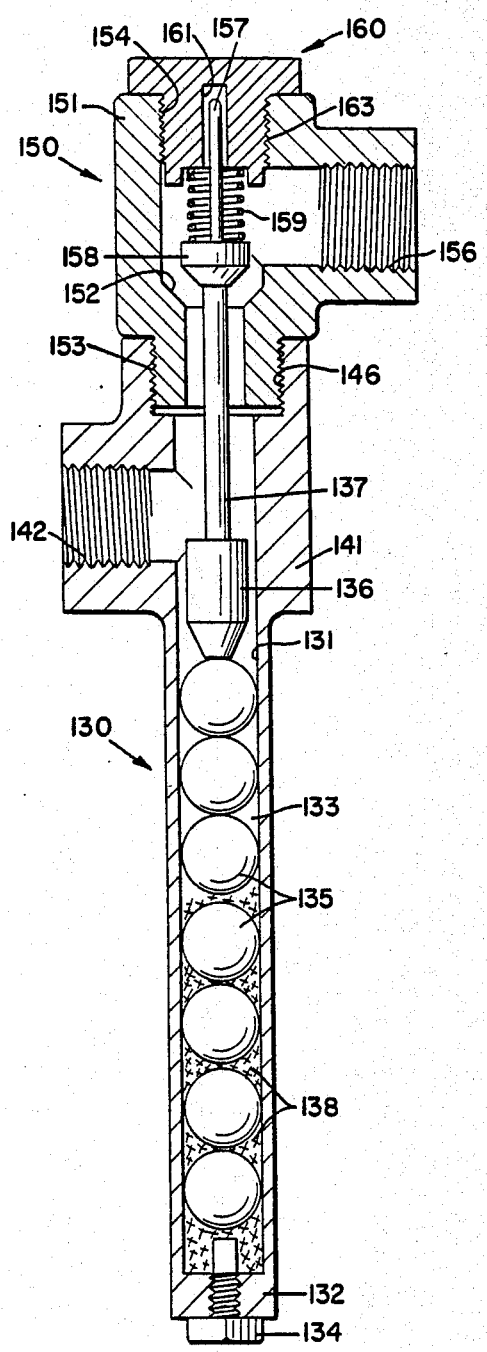
FIG. 16 is a sectional elevation of a commercially useful embodiment of the invention for a water system, containing a plurality of balls therein as preferred segments, in which the angled valve is in open position.
Figure 17:
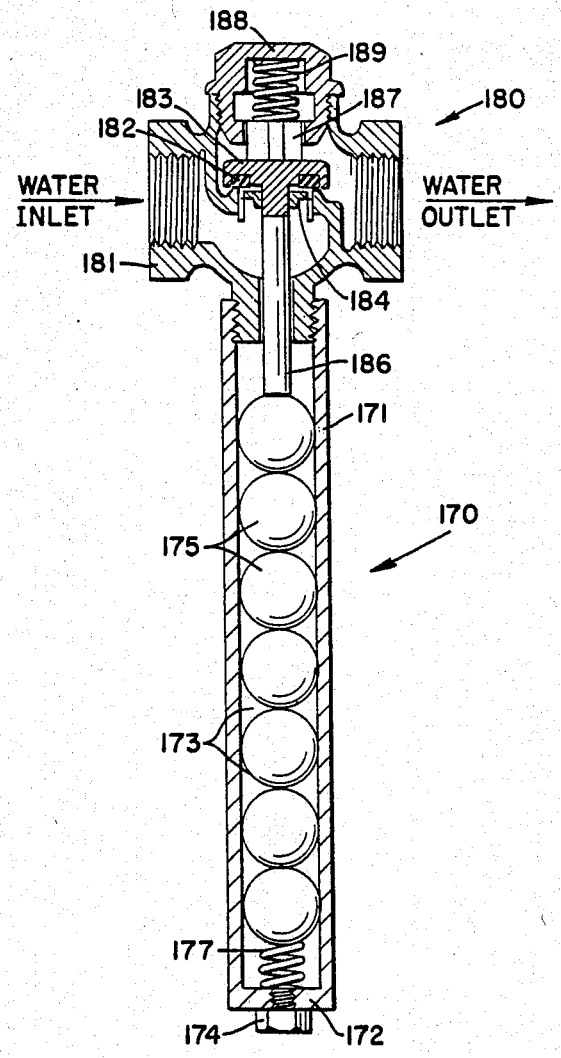
FIG. 17 is a sectional elevation of another commercially useful embodiment of the invention for a water system, also containing balls, in which the straight-through valve is in closed position.

Practical relief valve devices of this invention for water are shown in FIGS. 16 and 17. FIG. 16 shows an angle embodiment in open position, and FIG. 17 shows a straight-through embodiment in closed position.

The angle valve shown in FIG. 16 comprises a unitary actuator 130, a valve body 150, and a valve cap 160. Unitary actuator 130 comprises a cylindrical wall 131, a bottom end 132, an adjustment and bleed screw 134, a plurality of balls 135 which move freely within the chamber formed by wall 131, an actuation or linkage rod 136 which is in close contact with topmost ball 135, and an actuation pin 137 which is attached to rod 136 and axially aligned therewith.

Rod 136 and pin 137 can be of unitary construction. Unitary actuator 130 further comprises actuator body 141, threaded inlet 142, and threaded outlet 146.

Rod 136 forms a close fit with wall 131 in order to minimize downward circulation of inlet water and consequent melting of ice within the actuation chamber.

Valve 150 comprises valve body 151, valve seat 152, threaded inlet 153, threaded cap opening 154, outlet 156, valve poppet 158 which is axially aligned with pin 137 and attached thereto, compression spring 159, and guide pin 157 which is axially aligned with poppet 158 and attached thereto and around which spring 159 is disposed.

Valve cap 160 comprises bore 161, which is axially aligned with pin 157, poppet 158, actuation pin 137, and actuation rod 136, and threads 163 for attaching to body 151.

When ice 138 has replaced water 133 within the actuation chamber, lower balls 135 are spaced apart, as shown in FIG. 16, to displace poppet 158 from valve seat 152 so that water entering through inlet 142 can pass through the port around actuation pin 137 and between valve poppet 158 and valve seat 152 to be discharged through outlet 156.

FIG. 17 shows a highly preferred embodiment comprising an actuator 170 and a globe valve 180. Actuator 170 comprises a housing formed by cylindrical wall 171 and a bottom end 172 in which is fitted a bleed screw 174. The housing surrounds an actuation chamber within which are balls 175 as segments of its expansion sensing means, a wear compensation spring 177, and water 173.

Compression spring 177 is useful in order to compensate for slight wear in balls 175. Its force is always less than compression spring 189 and is merely enough to keep balls 175 in contact with each other and to localize the total linear wear within the volume beneath the bottom ball.

Globe valve 180 comprises valve body 181, valve seat 182, valve poppet 183, poppet guide 184, actuation rod 186, adjustment nut 187, cap 188, and compression spring 189. This globe valve is a major portion of a quick-opening, self-closing globe valve Model 305B made by the S.C. Kingston Co., 1007 N. Main St., Los Angeles, Calif. 90012. Valves formerly made by the Walworth Co., P.O. Box 873, Valley Forge, Pa. 19481, would also be useful for the device of this invention.

Mass

Pertinent mass considerations are as follows:

(1) In the actuator, the ratio of the mass of the metal (chamber wall, chamber bottom, and balls) to the mass of the water is approximately 40:1.

(2) In the inlet piping, the ratio of the mass of the metal to the mass of the water is approximately 3:1.

(3) The ratio of the mass of the metal in the inlet piping and relief valve to the mass of metal in the actuator is approximately 1:0.

(4) The ratio of the mass of the water in the relief valve to the mass of the water in the chamber is approximately 50:1.

Heat

Pertinent data are as follows:

| Material | Specific Heat | Thermal Conductivity BTU/Hour-Ft$^3$-°F.-Ft | Specific Gravity |
|---|---|---|---|
| Water | 1.00 | 0.33 | 1.0 |
| Ice | 0.50 | 1.26 | 0.9 |
| Copper, 99% | 0.09 | 224 | 8.9 |
| Brass | 0.09 | 56–81 | 8.5–8.7 |
| Bronze | 0.09 | 15–108 | 8.6–8.8 |
| Cr—Ni Steel | 0.11 | 9.70 | 8.0 |

The heat of fusion of water to ice is 143 BTU/pound.

Heat Transfer During Freeze

Assuming that the ambient temperature has dropped below 32° F., heat flows out of the chamber wall to the air while heat flows into the actuator by flowing down the chamber wall from the inlet piping, the relief valve, and the water contained therein. Consequently, the temperature of the water of the lower part of the chamber tends to drop faster than the water in the upper part thereof. Within the chamber, the mass of the metal to the mass of water is approximately 40:1. Since the specific heat of the metal is approximately 0.1, it requires about four times as much heat loss from the metal as it does from the water to lower the temperature to 32° F.

However, the amount of heat loss required to lower the temperature of the water to 32° F. is insignificant compared to the heat loss required to transform the water to ice at 143 BTU/pound of water. The result is that the temperature of the water and the balls tends to remain at 32° F. until the water is frozen because the temperature necessarily remains constant during a phase transition period. At that time, the temperature of the outside chamber wall drops below 32° F. and the water starts to freeze along the interior of the wall. This process begins at the bottom of the chamber and moves upwardly therefrom. As the heat loss continues, the ice forms a seal between each ball and its surrounding wall, thereby trapping the water located between the lower portion of the ball and the next lowermost ball. As the water continues to freeze, the ice forms a wedge which forces the balls apart. Because the lowermost balls have already formed a solid frozen mass, the ball above the wedge being formed moves upwardly against the compression spring. This process continues as each ball successively moves upwardly until a balance zone is reached. This balance zone occurs when heat loss through the wall of the chamber equals the heat gained through the metal from the inlet piping, the relief valve, and water contained therein. The balance zone may move up or down, depending upon the balance of heat flow along and through the wall of the actuation chamber.

Heat Transfer During Thaw

Assuming that the ambient temperature increases above 32° F. after a freeze, heat is gained through the chamber wall from the ambient air, causing progressive melting of the ice from the outside of the wall toward the center of the chamber. Heat continues to be gained from the valve body and the water therewithin to cause melting of the ice from the top of the chamber downwardly. The balance zone consequently moves far down the chamber wall. The last ice to melt is that between the balls; therefore, the balls will not move together and the valve will not close until all of the ice has melted. It is critical that only water remain between the balls and that the balls come back into contact with each other, because if a re-freeze occurs, expansion of the freezing water will be necessary for re-actuation of the relief valve.

Assuming that the ambient temperature remains below 32° F., that the valve is actuated, and that the heat gained from the valve body and the water therewithin because of water flow far exceeds the heat loss, this incoming heat will flow downwardly through the balls and through the water between the balls. Because the chamber wall is below 32° F., the seal between the balls and the water tends to be the last ice to melt and occurs from the interior outwardly until all ice has melted. In other words, the balance zone remains at a relatively high level. Because this seal remains until after the interior ice has melted, a re-freeze can occur.

Linear Expansion Within Chamber Above Bottom Ball

Figure 21:
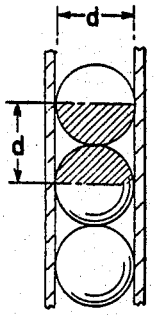
FIG. 21 is a schematic sectional elevation of a portion of an actuation chamber having three balls therein.
Figure 22:
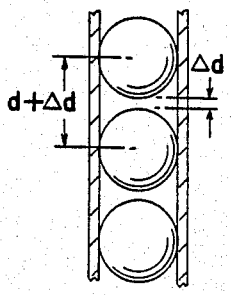
FIG. 22 is a schematic sectional elevation of the same chamber portion and balls as FIG. 21 in which the balls are separated by ice formed therebetween.

Referring to FIGS. 21 and 22, the shaded area in FIG. 21 represents a portion of the chamber volume having a length d. The linear expansion per ball in this chamber, having an inside diameter of d, may be calculated as follows when water freezes into ice and expands approximately 10% by volume:

Volume of Balls ($\frac{1}{2}$ of 2 balls = 1 ball)

$$Vb=\pi d^3/6$$

Volume of Empty Chamber Per "d" Length $$Ve=\pi(d/2)\times d=\pi d^3/4$$

Volume of Water in "d" Length $$Vw=Ve-Vb$$

$$Vw=\pi d^3/4-\pi d^3/6$$

$$Vw=\pi d^3/12$$

Volume of Expansion ($\Delta V$)

$$\Delta V=\pi d^3/12\times 10\%=\pi d^3/120$$

Length of Expansion ($\Delta d$)

$$\Delta V=(d/2)^2\pi\times\Delta d$$

$$\pi d^3/120=\pi d^2/4\times\Delta d$$

$$\Delta d=d/30$$

The linear expansion is therefore directly proportional to the diameter of the chamber and the number of spaces between the balls, i.e., the total expansion = d/30 × (number of balls − 1).

LINEAR EXPANSION IN BOTTOM OF CHAMBER BENEATH BOTTOM BALL

Figure 23:
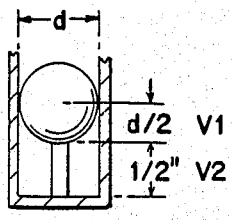
FIG. 23 is a schematic sectional elevation of the bottom of the actuation chamber of FIGS. 21 and 22, showing the bottom ball and a cap screw providing linear adjustment.

Referring to FIG. 23, the adjustment screw or pin at the bottom of the chamber may be of any reasonably desired 1 length and, in general, provides a selective increase in the linear expansion that is available. For a ball d in a chamber having a diameter d and a pin of 3/16-inch diameter, the calculation of the expansion in the bottom of the chamber, beneath the bottom ball, is as follows:

Volume ($V_1$) of Water in Length of (d/2)

$$V_1=\text{Volume w/o Ball}-\text{Volume of }\tfrac{1}{2}\text{ Ball}$$

$$V_1=\pi/4\times d^2\times d/2-\tfrac{1}{2}\times\pi d^3/6$$

$$V_1=\pi d^3/8-\pi d^3/12$$

$$V_1=\pi d^3/24$$

Volume ($V_2$) of Water in Length of $\frac{1}{2}$ inch $$V_2=\text{Volume w/o Pin}-\text{Volume Pin}$$

$$V_2=\pi/4\times d^2\times\tfrac{1}{2}-\pi/4\times(3/16)^2\times\tfrac{1}{2}$$

$$V_2=\pi/8)d^2-9/256)$$

Total Volume of Water ($V_t$)

$$V_t-V_1+V_2$$

$$V_t=\pi d^3/24+\pi/8(d^2-9/256)$$

$$V_t=\pi/8(d^3/3+d^2-9/256)$$

Volume of Expansion ($\Delta V$)

$$\Delta V=Vt\times 10\%$$

$$\Delta V=0.10\times\pi/8(d^3/3+d^2-9/256)$$

$$\Delta V=\pi/80(d^3/3+d^2-9/256)$$

Length of Expansion ($\Delta d$)

$$\Delta d = \Delta V \div \text{Cross Sectional Area } (A)$$

$$A = \pi d^2/4$$

$$\Delta d=\pi/80(d^3/3+d^2-9/256)\div\pi d^2/4$$

$$\Delta d=1/20(d/3+1-9/256d^2)$$

$$\Delta d=d/60+1/20-9/5120d^2$$

The expansion due to water freezing within the actuation chamber is directly proportional to the amount of water in the chamber, the number of segments, shape of segments, the diameter of the chamber, and the size of the bottom of the chamber. For a single ball, only the expansion in the bottom of the chamber is relevant. Calculated expansions for three sizes of balls in similarly sized actuation chambers are given in the following table.

TOTAL LINEAR EXPANSION, INCHES

| Diameter of Chamber Inches | Number of Balls in Chamber 1 | 2 | 3 | 4 | 5 | 6 | 7 | 8 |
|---|---|---|---|---|---|---|---|---|
| $\frac{1}{2}$ | 0.051 | .068 | .085 | .101 | .118 | .135 | .151 | .168 |
| $\frac{3}{4}$ | 0.059 | .084 | .109 | .134 | .159 | .184 | .209 | .234 |
| 1 | 0.064 | .098 | .132 | .165 | .198 | .232 | .265 | .298 |

If the freeze prevention device of this invention is designed (1) with a large bottom chamber and (2) so that the balance zone never reaches any segment, it is possible to use a single segment. In other words, having a single segment that can never have its seal melted by incoming heat from the inlet piping, valve body, and water therein means that its seal can always be reformed before water beneath the segment can escape because of expansion therein. Maintaining the balance zone always above such a single segment is possible by use of insulation between the actuator and the relief valve or by having a sufficiently elongated actuator and particularly one having a sufficiently high length-to-diameter ratio.

However, it is preferred that the number of segments be at least two. It is highly preferred that a larger plurality of segments, such as six, be used. Such a larger number imparts greater versatility to the device and enables the incoming heat from the inlet piping, the relief valve, and the flowing water therein to be utilized for faster thawing and generally more precise responses to temperature changes.

Because it will be readily apparent to those skilled in the art of freeze prevention that innumerable variations, modifications, applications, and extensions of the examples and principles hereinbefore set forth can be made without departing from the spirit and the scope of the invention, what is hereby defined as such scope and is desired to be protected should be measured, and the invention should be limited, only by the following claims.

What is claimed is:

1. In a freeze prevention device comprising a valve which has an inlet, an outlet, and a compression spring, an improved actuator comprising A. a rigid housing, which is sealably connected at one end thereof to said valve and closed at the other end and which surrounds an actuation chamber which is adapted to contain a liquid that expands when freezing to form a solid; and B. at least one segment of a means for sensing the expansion of said solid being formed during said freezing, said segment having an uninterrupted peripheral portion extending substantially to said housing and said segment being movably disposed within said chamber, whereby:

(1) a solid seal forms between said peripheral portion and said housing when said freezing initially occurs near said closed end and along said housing, (2) said segment moves upwardly without destroying said solid seal when freezing of said liquid occurs above said closed end and beneath said segment, and (3) said valve is opened.

2. The improved actuator of claim 1, wherein said means comprises at least two segments thereof.

3. The improved actuator of claim 2, wherein said means senses said expansion both incrementally and cumulatively.

4. The improved actuator of claim 3, wherein said segments are operably connected to a linkage means which transmits said incrementally and cumulatively sensed expansion to a valve poppet within said valve, whereby said poppet is selectively separated, against said compression spring, from a valve seat within said valve, said valve seat being connected to and in control of a valve port between said inlet and said outlet.

5. The improved actuator of claim 4, wherein said valve is operably connected at said inlet to a fluid system, whereby said separation of said poppet from said seat allows a selected quantity of fluid to be discharged at said outlet from said fluid system.

6. The improved actuator of claim 5, wherein said liquid is water and said fluid system is a water system, whereby said discharged fluid is water being selectively bled from said system which is thereby protected from freezing.

7. The improved actuator of claim 6, wherein said water system is a water supply system.

8. The improved actuator of claim 5, wherein said liquid is water and said fluid system is a steam system, whereby said separation of said poppet from said seat allows a selected quantity of steam to be discharged at said outlet from said steam system.

9. The improved actuator of claim 8, wherein said discharged steam is fed during freezing weather to a steam tracer system for protecting pipelines containing aqueous liquids from freezing thereof.

10. The improved actuator of claim 9, wherein said actuator is insulated to the same extent as said pipelines are insulated.

11. The improved actuator of claim 9, wherein said actuator is insulated to a lesser extent than said pipelines are insulated.

12. The improved actuator of claim 5, wherein said liquid is water and said solid is ice which is melted within said actuator during a thaw, whereby said separation against said spring of said poppet from said seat is reversed and said poppet is again in contact with said seat and said discharge of said fluid selectively ceases.

13. The improved actuator of claim 5, wherein said segments are a plurality of balls which fit closely and are freely movable within said chamber.

14. The improved actuator of claim 13, wherein said segments and said housing are formed from the same material.

15. The improved actuator of claim 14, wherein said material is selected from the group consisting of copper alloys and stainless steels.

16. The improved actuator of claim 15, wherein said copper alloys are selected from the group consisting of bronze, brass, and copper.

17. The improved actuator of claim 5, wherein said housing additionally comprises a bleed cap screw at said closed end.

18. The improved actuator of claim 17, wherein said housing additionally comprises a wear compensation spring at said closed end.

19. The improved actuator of claim 5, wherein:

A. an actuation rod is disposed within said chamber and is operably in contact with said expansion sensing means; and B. said valve comprises a valve body having a control opening at which said housing is sealably attached, said valve poppet being operably in contact with said actuation rod, operably disposed within said valve, and adapted for fitting against said valve seat when said water is at temperatures above said freezing temperatures, whereby said actuation rod transmits said expansion from said expansion sensing means to said valve poppet.

20. The improved actuator of claim 5 wherein:

A. said segments are shaped as balls;

B. said chamber is cylindrical in shape; and

C. said balls have a diameter approximately equal to the diameter of said chamber and are freely movable therewithin.

21. The improved actuator claim 5, wherein said segments are shaped as double cones and are aligned within said chamber so that apexes of said cones are in abutting relationship and substantially coincide ,with the central axis of said chamber.

22. The improved actuator of claim 5, wherein said segments are shaped as disks and are spaced apart along the length of said chamber.

23. The improved actuator of claim 19, wherein said valve body additionally comprises a valve cap having a bore which is in alignment with said linkage means.

24. The device of claim 23, wherein said valve additionally comprises:

A. a stem, which is attached to said poppet and is guided within said bore as said poppet opens and closes said port; and B. a spring, which is compressed between said cap and said poppet to maintain said poppet seated against said valve seat when said temperatures are above said freezing temperatures.

25. The improved actuator of claim 23, wherein said housing further comprises a shaft cap screw which is threadably attached to said closed end thereof and in alignment with the central longitudinal axis of said chamber.

26. The device of claim 25, wherein said screw extends sufficiently that a single said segment is interposed, as said expansion sensing means, between ends of said screw and said actuation rod.

27. The improved actuator of claim 1, wherein said wall and said periphery are spaced apart by approximately 0.0025 inch.

28. A method for incrementally and cumulatively sensing the expansion of a liquid while freezing, comprising:

A. providing an actuator having an elongated housing which is disposed substantially vertically and has a wall, an open end, and a closed end to define an elongated actuation chamber which is filled with said liquid;

B. providing a plurality of segments of a sensing means which is disposed within said chamber, each said segment having an uninterrupted peripheral portion extending substantially to said wall and an axial portion extending toward said closed end, said segments being biased toward said closed end;

C. providing a linkage means that is in contact with the topmost segment and is aligned substantially axially with said housing;

D. exposing said actuator to freezing temperatures;

E. forming a solid seal between each said peripheral portion and said wall when freezing of said liquid initially occurs near said closed end and along said wall; and F. moving each said segment sequentially upwardly without destroying said solid seal when freezing of said liquid occurs above said closed end and beneath each said segment, whereby said linkage means is pushed upwardly for controlling flow of a fluid and preventing freezing thereof.

29. The method of claim 28, wherein:

A. connection is provided between said linkage means and the poppet of a valve controlling flow of said fluid that is to be protected from freezing or that is to be used to protect another fluid from freezing; and B. said incrementally and cumulatively sensed expansion is transmitted by said linkage means to said poppet, whereby said valve is opened and said fluid is controllably allowed to flow.

30. The method of claim 29 which further comprises providing thermal insulation around said housing for reducing outward heat transfer.

31. The method of claim 29 which further comprises providing thermal insulation between said valve and said actuator for reducing heat transfer from said valve to said actuator.

32. The method of claim 28, wherein both said fluid and said liquid are water.

33. The method of claim 28, wherein said fluid is steam and said liquid is water.

* * * * *

UNITED STATES PATENT AND TRADEMARK OFFICE

CERTIFICATE OF CORRECTION

PATENT NO. : 4,784,173

DATED : November 15, 1988

INVENTOR(S) : Frederick P. Carney

It is certified that error appears in the above-identified patent and that said Letters Patent is hereby corrected as shown below:

In the Abstract:

First page, line 12, change "meovement" to --movement--.

In the Specification:

Column 5, line 32, change "(b3)" to --(3)--.

Column 10, line 4, change "test" to --tests--.

Column 11, line 35, change "178-inch" to --1/2 inch--.

Column 11, line 59, change "ere" to --were--.

Column 13, line 60, change "subject 1" to --subject--.

UNITED STATES PATENT AND TRADEMARK OFFICE

CERTIFICATE OF CORRECTION

PATENT NO. : 4,784,173

DATED : November 15, 1988

INVENTOR(S) : Frederick P. Carney

It is certified that error appears in the above-identified patent and that said Letters Patent is hereby corrected as shown below:

In the Specification:

Column 19, line 32, change "Ve = (d/2) x d = $d^3/4$" to --Ve = $(d/2)^2$ x d = $d^3/4$--

Column 19, line 63, change "desired l" to --desired--.

Column 20, line 17, change "$V_2$ = /8)$d^2$ - 9/256)" to --$V_2$ = /8 ($d^2$ - 9/256)--.

Column 20, line 21, change "$V_t$ - $V_1$ + $V_2$" to --$V_t$ = $V_1$ + $V_2$--.

In the Claims:

Claim 23, line 3, change "means" to --rod--.

Signed and Sealed this

Twentieth Day of June, 1989

*Attest:*

*Attesting Officer*

DONALD J. QUIGG

*Commissioner of Patents and Trademarks*